United States Patent [19]

Dunn

[11] Patent Number: 4,526,126

[45] Date of Patent: Jul. 2, 1985

[54] RUBBER BOAT STERN SUPPORT DEVICE

[76] Inventor: Richard G. Dunn, 4605 Ramblewood Dr., Greensboro, N.C. 27406

[21] Appl. No.: 561,956

[22] Filed: Dec. 15, 1983

[51] Int. Cl.[3] ..... B63B 23/62

[52] U.S. Cl. ..... 114/365; 114/190; 441/80

[58] Field of Search ..... 114/343, 364, 365, 366, 114/361, 362, 360, 372, 190, 374; 441/42, 80, 81, 82; 414/679, 729; 248/359, 359.1, 360

[56] References Cited

U.S. PATENT DOCUMENTS

| | | | |
|---|---|---|---|
| 1,224,819 | 5/1917 | Wigren | 114/190 |
| 1,517,562 | 12/1924 | Ljungman et al. | 114/370 |
| 1,830,134 | 11/1931 | Sacerdoti | 114/370 |
| 3,065,475 | 11/1962 | Smith | 114/365 |
| 3,143,991 | 8/1964 | Anderson | 114/365 |
| 3,326,161 | 6/1967 | Johns | 114/372 |
| 3,381,646 | 5/1968 | Ledford | 414/729 |
| 3,685,476 | 8/1972 | Routery | 414/679 |
| 3,690,282 | 12/1972 | Busby | 114/365 |
| 3,834,338 | 9/1974 | Renouf | 414/679 |
| 3,925,836 | 12/1975 | Simmonds | 114/364 |

*Primary Examiner*—Trygve M. Blix
*Assistant Examiner*—Stephen P. Avila
*Attorney, Agent, or Firm*—Barlow & Barlow, Ltd.

[57] ABSTRACT

A device for storing and carrying an inflatable pontoon boat on a yacht features upwardly opening hooks that engage a pontoon so that the boat may rest against the stern of a yacht. The hooks are supported on a post swivably attached to a stern pulpit. The boat may be hoisted upwardly using a line attached to one pontoon and then into the hooks in which position the boat is fastened in place with line.

3 Claims, 4 Drawing Figures

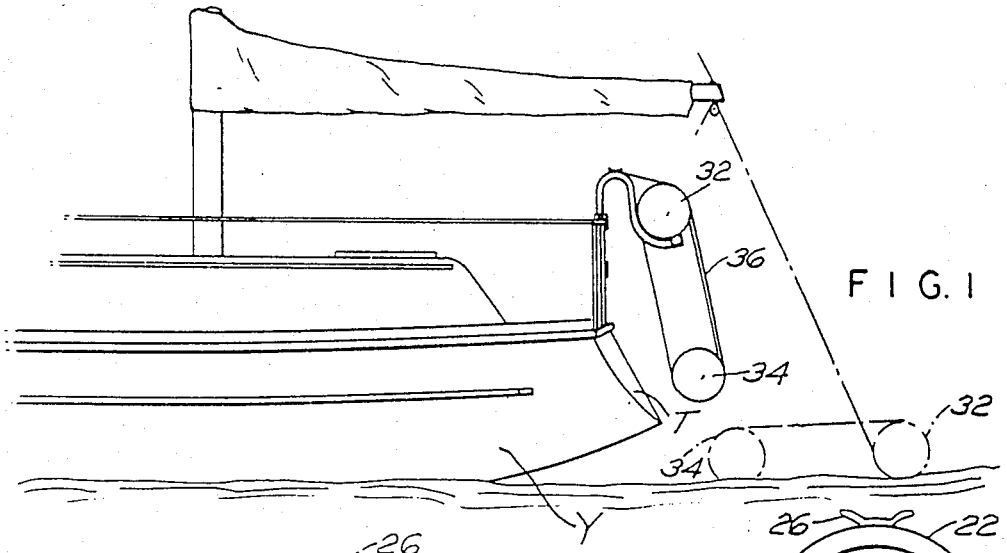
FIG. 1
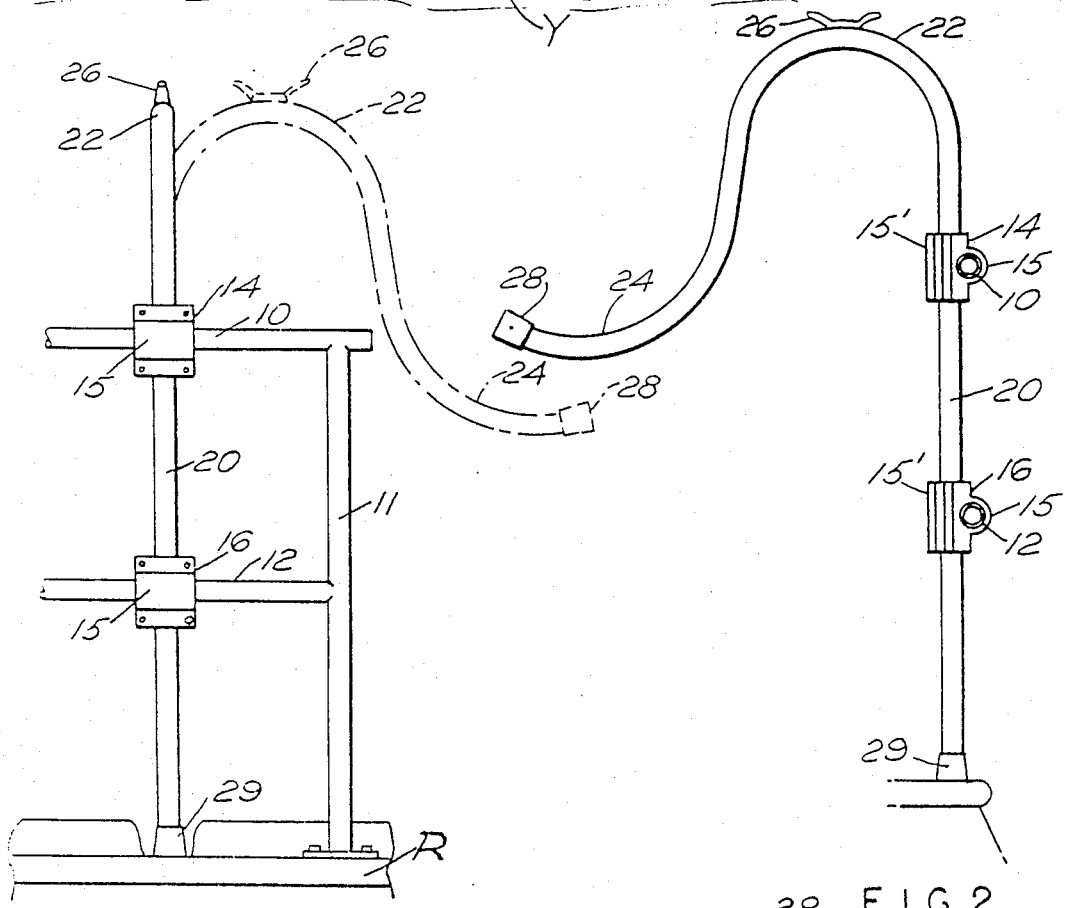
FIG. 3
FIG. 2
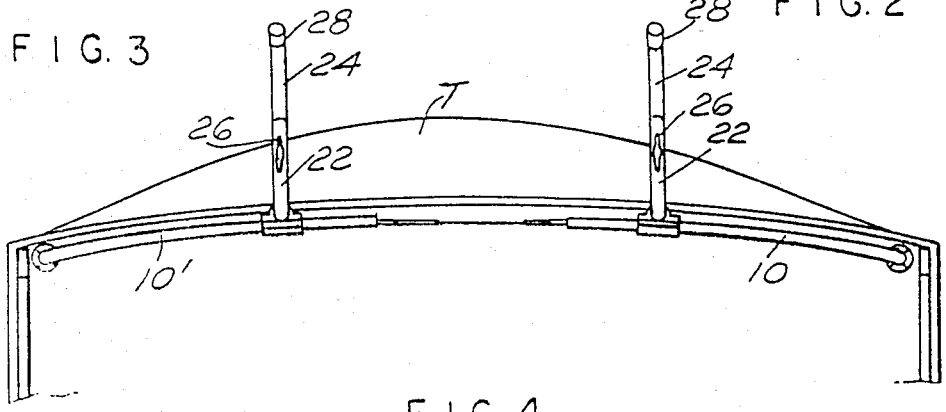
FIG. 4

RUBBER BOAT STERN SUPPORT DEVICE

BACKGROUND OF THE INVENTION

This invention relates to a simple, yet effective, carrying device for an inflatable pontoon boat as transported on a yacht. To secure an inflatable boat onto a yacht presents a number of difficulties because the size of the boat with its pontoons is such that it does not stow easily on deck and often does not adapt itself to being hoisted on conventional davits, since there are limited support devices to attach lifting devices used with davits.

Accordingly, it is a principal object of this invention to provide an improved storage device for inflatable boats or dinghies of moderate size which may be conveniently secured and hoisted by hand or by the use of a boom and tackle, and then stored on the stern of a yacht for transport.

Still another object of the invention is to provide an inexpensive storage device for an inflatable boat which is versatile and will adapt itself to various sized pontoons.

In the illustrated embodiment of the device there is provided a vertical post which has an upward end curved downwardly and outwardly to form an upwardly opening hook. The post is secured to a stern pulpit of a yacht, the stern pulpit comprising generally a plurality of horizontal and vertical members or stanchions, the vertical part of the post being preferably attached to the stern pulpit by brackets into which the post may swivel, so that when it is desired to move the storage device out of operative position, it may be moved athwartships and be conveniently stowed. Lines extending from one pontoon across another pontoon may secure the inflatable boat into the upwardly opening hook area; and the inflatable boat may hang downwardly, either spaced away from the stern or possibly resting thereon in a reverse transom type of yacht.

BRIEF DESCRIPTION OF THE DRAWINGS

FIG. 1 is an elevational view showing the invention mounted on the stern of a yacht with an inflatable boat in position, the broken line position illustrating the initial position of the boat;

FIG. 2 is a side elevational view showing the post;

FIG. 3 is a rear elevational view showing the post in operative and stowed positions, stowed position being illustrated in broken lines; and FIG. 4 is a top view showing the post mounted on the stern pulpit of a yacht.

DETAILED DESCRIPTION OF THE PREFERRED EMBODIMENT

Referring now to the drawings, there is illustrated the stern portion of a yacht Y which, purely by way of example, has a reverse transom T on the rail of which is fitted a stern pulpit having horizontal and vertical members 10, 11 also referred to as horizontal rails 10, 10' and vertical stanchions 11. The pulpit may also be fitted, as illustrated, with intermediate horizontal rails 12. Attached to the horizontal rails are brackets 14, 16 which in their most simplistic form, may comprise a pair of cast blocks, each having a semi-circular portion 15 and 15', which respectively receive in cylindrical sockets the horizontal portion of the pulpit and the vertical post of the storage device and are then fastened together so that the vertical post may swivel therein. The storage device then essentially consists of a vertical post member 20 having an upper end 22 that is curved in a downward direction and thence outwardly as at 24 to form an upwardly opening hook. For fastening purposes a cleat 26 is provided on the upper curved end and protection means in the form of a tip 28 may be placed on the end of the upwardly opening hook end as well as a similar tip 29 on the lower end of the vertical portion of the device. Essentially then, the device can rest on a rail R at the stern of a vessel and be supported in a general upward direction by the brackets 14, 16.

In use, an inflatable boat which has a pair of pontoons 32, 34 that are connected together by a bottom piece 36, will be resting in the water at the stern of the yacht (see FIG. 1). Lines attached adjacent the pontoon 32 may be picked up and led to a boom or other hoisting device as a halyard on a sailboat, which will then elevate that part of the inflatable boat and lift it upwardly from whence position it can be swung into the upwardly opening hook of the post. At this juncture the inflatable boat may be secured in a number of ways, as for example, taking a line from the lower pontoon 34 and leading it around the outside perimeter of the pontoon 32 and thence across the boat onto the cleat 26 located on the post at the other side of the yacht. Similarly, another line can be taken from the bow section of the inflatable boat and led across again the outside perimeter of the pontoon 32 to the other cleat 26. While this crossed line fastening scheme is purely exemplary of one manner of fastening, obviously other concepts will appear to those skilled in the art that will be equally effective in holding the inflatable boat in position on the upwardly opening hook portions of the posts.

I claim:

1. An inflatable boat storage device for suspending the boat at the stern of a yacht, said boat having a pair of spaced pontoons, said yacht having a stern pulpit with horizontal and vertical members, said device comprising a pair of posts each with an upper end curved downwardly and outwardly to form an upwardly opening hook, said posts being spaced apart and swivably affixed to one of said members intermediate the ends of the posts, the lower end of the posts resting on the yacht whereby the upward opening hooks engage one of the pontoons of the boat for supporting the boat in a general vertical position.

2. An inflatable boat storage device as in claim 1 wherein brackets clamped to the members have sockets that receive the posts.

3. The method of storing an inflatable boat having pontoons on the stern of a yacht having a stern pulpit with horizontal and vertical members comprising providing at least two vertical posts with curved upwardly opening rests extending away from the stern, positioning the posts so that the upper ends lie above the uppermost horizontal members of the pulpit, attaching a line to one pontoon, hoisting the boat by said line to a position where the pontoons are one above the other, and one is above the upwardly opening rests, moving said one pontoon onto said rests and fastening the boat to the rests.

* * * * *